US005607090A

United States Patent [19]

Brown

[11] Patent Number: 5,607,090

[45] Date of Patent: Mar. 4, 1997

[54] SAFETY DEVICE

[76] Inventor: Roland J. Brown, 2722 Dublin St., New Orleans, La. 70118

[21] Appl. No.: 365,040

[22] Filed: Dec. 28, 1994

[51] Int. Cl.[6] ..... A45F 3/00

[52] U.S. Cl. ..... 224/217; 224/221; 224/148.5; 224/251; 222/175

[58] Field of Search ..... 224/148, 219, 224/221, 217, 218, 222, 267, 251, 148.5; 222/175

[56] References Cited

U.S. PATENT DOCUMENTS

| | | | |
|---|---|---|---|
| D. 249,592 | 9/1978 | Libonati | D87/3 R |
| D. 259,220 | 5/1981 | Small et al. | D2/400 |
| D. 280,255 | 8/1985 | Blaivas | D2/383 |
| D. 288,743 | 3/1987 | Taylor | D3/106 |
| D. 339,472 | 9/1993 | Parker | D3/100 |
| D. 347,733 | 6/1994 | Miller | D3/226 |
| 2,749,000 | 6/1956 | McKittrick | 224/218 |
| 3,445,046 | 5/1969 | Wilson | 222/175 |
| 4,489,867 | 12/1984 | Schwemberger | 224/222 |
| 4,511,062 | 4/1985 | Wilkerson | 222/175 |
| 4,998,653 | 3/1991 | LaBelle . | |
| 5,009,347 | 4/1991 | Phelps | 224/219 |
| 5,088,624 | 2/1992 | Hackett et al. | 222/175 |
| 5,127,545 | 7/1992 | French | 224/219 |
| 5,341,972 | 8/1994 | Jacks | 224/165 |

FOREIGN PATENT DOCUMENTS

| | | | |
|---|---|---|---|
| 110611 | 10/1917 | United Kingdom | 224/221 |

*Primary Examiner*—Linda J. Sholl
*Attorney, Agent, or Firm*—Joseph N. Breaux

[57] ABSTRACT

An arm mounted safety device having a receiving structure for holding a liquid repellant canister which may be used for self protection. The receiving structure orients the liquid repellant in the direction of an attacker during a defensive reflex move, allowing the victim to discharge the repellant quickly with one hand in the direction of the attacker.

3 Claims, 4 Drawing Sheets

SAFETY DEVICE

TECHNICAL FIELD

The present invention relates to devices used for self protection and, more particularly, to devices used for self protection that are mountable to the arm of a user and which have a receiving structure for holding a liquid repellant canister.

BACKGROUND ART

Joggers and other persons participating in solitary physical activities outdoors often find themselves the victims of violent crimes such as rape. In an effort to protect themselves, joggers often carry liquid repellant canisters containing a liquid repellant, such as mace, which, when sprayed in an attacker's face, will disable the attacker. Although carrying a liquid repellant can be a safe, effective form of self protection, attackers often attack with little or no warning and the victim is unable to retrieve the repellant canister, direct the nozzle of the repellant canister in the direction of the attacker, and discharge the repellant in time to defend themselves. It would be a benefit, therefore, to have a device, which automatically directed the nozzle of the repellant canister in the direction of the attacker through the normal defensive reflex of putting one's hands up toward one's face. It would be a further benefit if the device allowed the user to discharge the repellant with the use of one hand.

GENERAL SUMMARY DISCUSSION OF INVENTION

It is thus an object of the invention to provide a safety device that holds a canister of liquid repellant in a manner such that a quantity of the repellant may be discharged from the canister while supported by the safety device.

It is a further object of the invention to provide a safety device that directs the nozzle of a liquid repellant canister in the direction of an attacker when a user reflexively puts his/her hands up towards his/her face.

It is a still further object of the invention to provide a safety device that has storage space for carrying personal items such as money and identification.

Accordingly, a safety device for holding a canister of the type containing a supply of liquid repellant and having a nozzle including an orifice through which the liquid repellant is discharged in a predetermined direction with respect to the nozzle orifice, is provided. The safety device comprises: a canister receiving member having a cavity having a longitudinal axis and of a size sufficient to receive therein a bottom portion of a canister containing a liquid repellant; a strap mechanism, attachable about the wrist of a user, and in functional connection with the canister receiving member in a manner such that when the strap mechanism is attached about the wrist of a user the longitudinal axis of the cavity is oriented along an exterior portion of the forearm of the user.

In a preferred embodiment, the cavity includes an interior sidewall which frictionally contacts an exterior portion of the canister in a manner such that the bottom portion of the canister is retained within the cavity when oriented in any direction.

In another preferred embodiment, the canister receiving member includes a lip section, adjacent the cavity, having a notched section partially forming an aperture through which the orifice of the nozzle may be directed.

In another preferred embodiment, the safety device further includes a canister having a supply of liquid repellant therein. The canister has a nozzle including an orifice through which the liquid propellent is discharged when a portion of the nozzle is acted on by a force in a second predetermined direction. In this preferred embodiment, the canister receiving member may include a lip section, adjacent the cavity, having a notched section partially forming an aperture through which the orifice of the nozzle may be directed. The cavity may include an interior sidewall which frictionally contacts an exterior portion of the canister in a manner such that the bottom portion of the canister is retained within the cavity when oriented in any direction.

In another preferred embodiment, an elongated support strap having a first end in functional connection with the canister receiving member and a second end having means for attaching the second end to a hand of the user in a manner such that the support strap acts to prevent the canister receiving member from sliding toward the elbow of a user when the strap mechanism is attached about the wrist of a user.

In another preferred embodiment, the safety device comprises: a canister, containing a supply of liquid repellant and having a nozzle including an orifice through which the liquid repellant is discharged in a predetermined direction with respect to the nozzle orifice; a pouch member, having a storage chamber therein accessible through a securable flap; a canister receiving member, mounted on a first exterior portion of the pouch member, having a cavity having a longitudinal axis and of a size sufficient to receive therein a bottom portion of the canister; a strap mechanism, connected to a second exterior portion of the pouch member and attachable about the wrist of a user, in functional connection with the canister receiving member in a manner such that when the strap mechanism is attached about the wrist of a user the longitudinal axis of the cavity is oriented along an exterior portion of the forearm of the user; and an elongated support strap having a first end in functional connection with the pouch member and a second end having means for attaching the second end to a hand of the user in a manner such that the support strap acts to prevent the canister receiving member from sliding toward the elbow of a user when the strap mechanism is attached about the wrist of a user. The cavity includes an interior sidewall which frictionally contacts an exterior portion of the canister in a manner such that the bottom portion of the canister is retained within the cavity is oriented in any direction. The canister receiving member includes a lip section, adjacent the cavity, having a notched section partially forming an aperture through which the orifice of the nozzle may be directed.

In another aspect of the invention, a method of carrying a supply of liquid repellant is provided. The carrying method comprises the steps of: a) providing a safety device comprising: a canister receiving member having a cavity having a longitudinal axis and of a size sufficient to receive therein a bottom portion of the canister; and a strap mechanism, attachable about the wrist of a user, and in functional connection with the canister receiving member in a manner such that when the strap mechanism is attached about the wrist of a user the longitudinal axis of the cavity is oriented along an exterior portion of the forearm of the user; b) providing a canister containing a supply of liquid repellant and having a nozzle including an orifice through which the liquid repellant is discharged in a predetermined direction with respect to the nozzle orifice; c) attaching the strap mechanism about the wrist of a user; and d) installing the canister into the canister receiving member in a manner such that the predetermined direction with respect to the nozzle orifice is oriented within degrees of a line perpendicular to the interior portion of the user's wrist.

In a preferred method, the safety device provided further includes an elongated support strap having a first end in functional connection with the canister receiving member and a second end having means for attaching the second end to a hand of the user in a manner such that the support strap acts to prevent the canister receiving member from sliding toward the elbow of a user when the strap mechanism is attached about the wrist of a user; and the method further includes the step of: e) attaching the second end of the support strap to the hand of the user.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
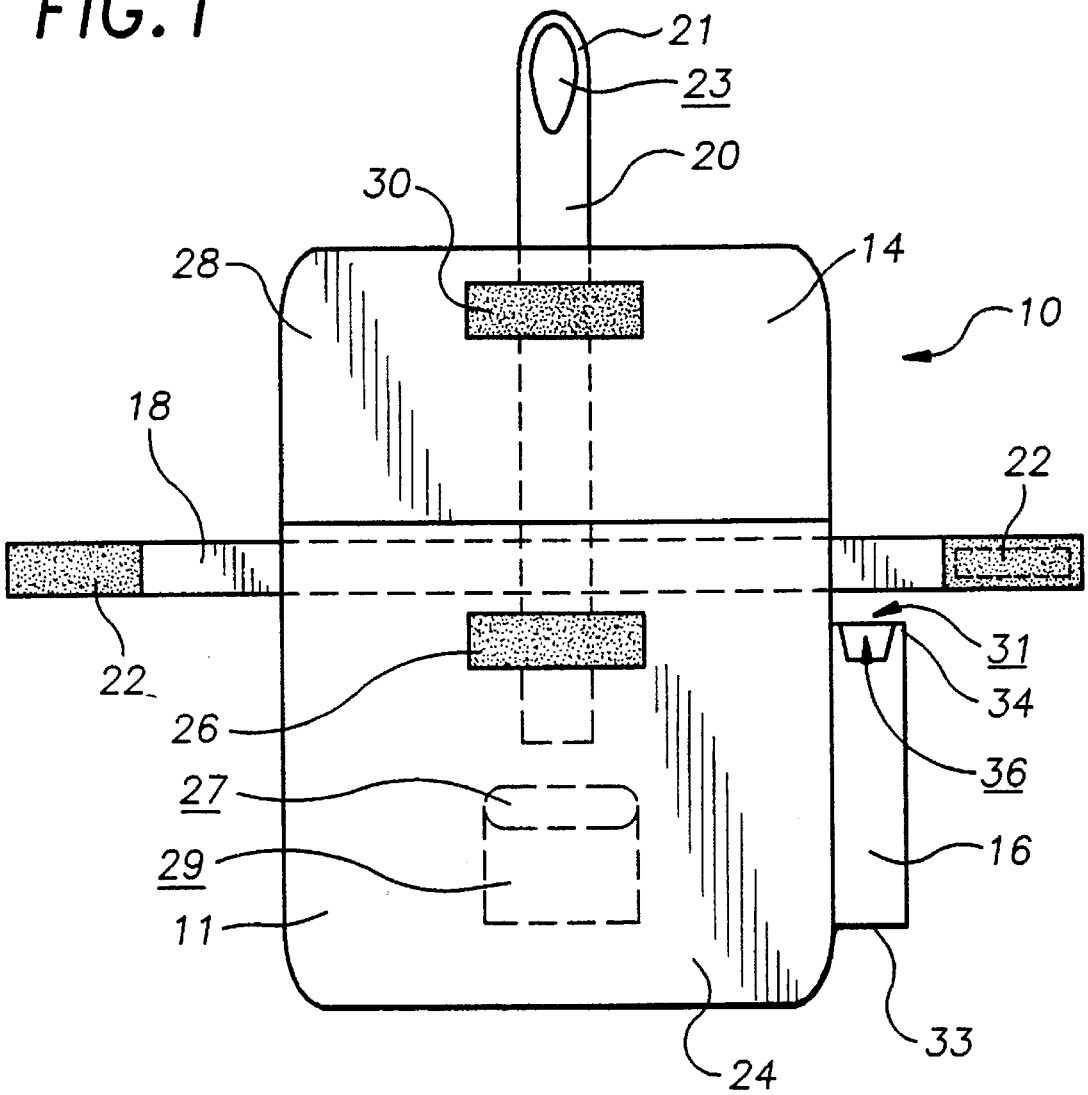
FIG. 1 is a front view of an exemplary embodiment of the arm mounted safety device.

Referring now to the figures, and in particular to FIG. 1, there is shown an exemplary embodiment of the arm mounted safety device of the invention, generally referred to by the numeral 10. Safety device 10 includes a pouch member 11, having a storage chamber therein (not shown) which is selectably closable with a securable flap 14; a canister receiving device 16; a wrist strap 18; and a support strap 20. In this exemplary embodiment, safety device 10 is adapted to be worn on the right wrist of a user.

Wrist strap 18 is an elastic band one-half inch in width and about ten inches in length with a section of hook and pile type fastener 22 attached at each end.

Support strap 20 is one inch in width and about five inches in length with a finger loop 21 having an aperture 23 of about three-quarters of an inch in diameter.

Pouch member 11 includes a front panel 24, which is a rectangular piece of fabric three inches in length by three and one-half inches in width, with a fastener 26 and an aperture 27 leading into a second cavity 29; and a back panel 28, which is a rectangular piece of fabric five inches in length and three and one-half inches in width having a fastener 30 that is compatible with fastener 26.

Canister receiving device 16 is tubular shaped section of elastic material two and one-half inches in length having a closed bottom 33 and including a lip 34 having a notched nozzle aperture 36 and defining an aperture 31 (more clearly shown in FIG. 2), and a canister cavity 32.

Figure 2:
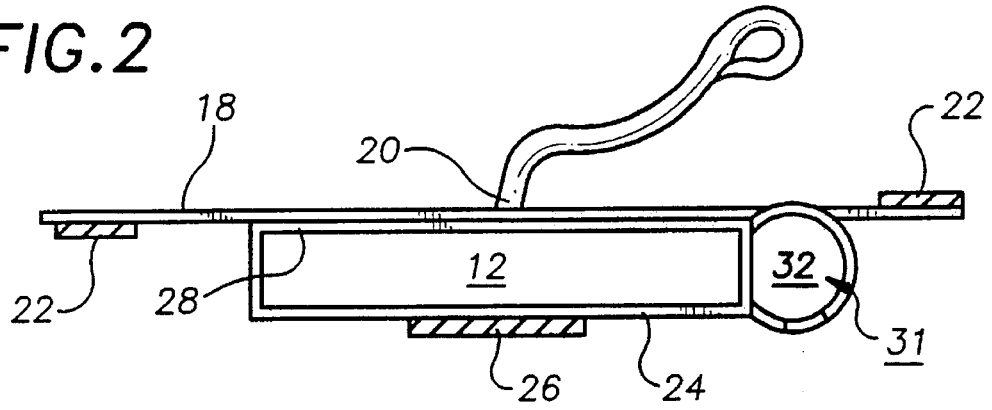
FIG. 2 is a top view of the embodiment shown in FIG. 1.

With reference to FIG. 2 which more clearly shows canister cavity 32 and storage chamber 12, front 24 and back 28 are connected by stitching on three sides forming chamber 12. Wrist strap 18 is attached to back 28 by stitching. Fasteners 22 are hook and pile fasteners. One end of support strap 20 is fastened to back 28 below flap 14 by stitching, perpendicular with wrist strap 18.

Figure 3:
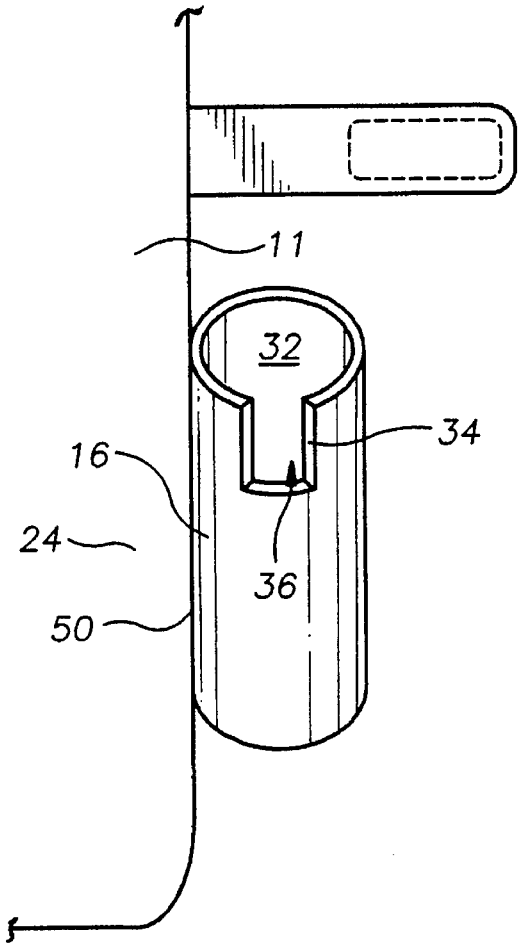
FIG. 3 is a side detail view of the canister receiving member of the embodiment shown in FIG. 1.

FIG. 3 shows canister receiving device 16 in isolation. Receiving device 16 is attached to the side 50 of pouch member 11 by stitching. Nozzle aperture 36 is formed by lip 34, is oriented facing in the same direction as front panel 24, and is in connection with canister cavity 32.

Figure 4:
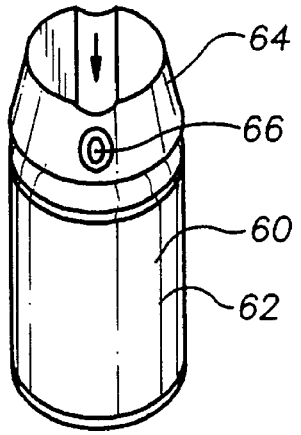
FIG. 4 is a perspective view of a representative liquid repellant canister of the type used in conjunction with the embodiment shown in FIG. 1.

FIG. 4 shows a representative liquid repellant canister 60. Repellant canister 60 includes a pressurized container 62, and a nozzle 64. Container 62 is filled with a supply of liquid mace and has a tube (not shown) in connection with nozzle 64. Nozzle 64 includes a nozzle orifice 66 and a contoured finger groove 68. When nozzle 64 is depressed, a stream of liquid mace is dispensed out through nozzle orifice 66.

Figure 5:
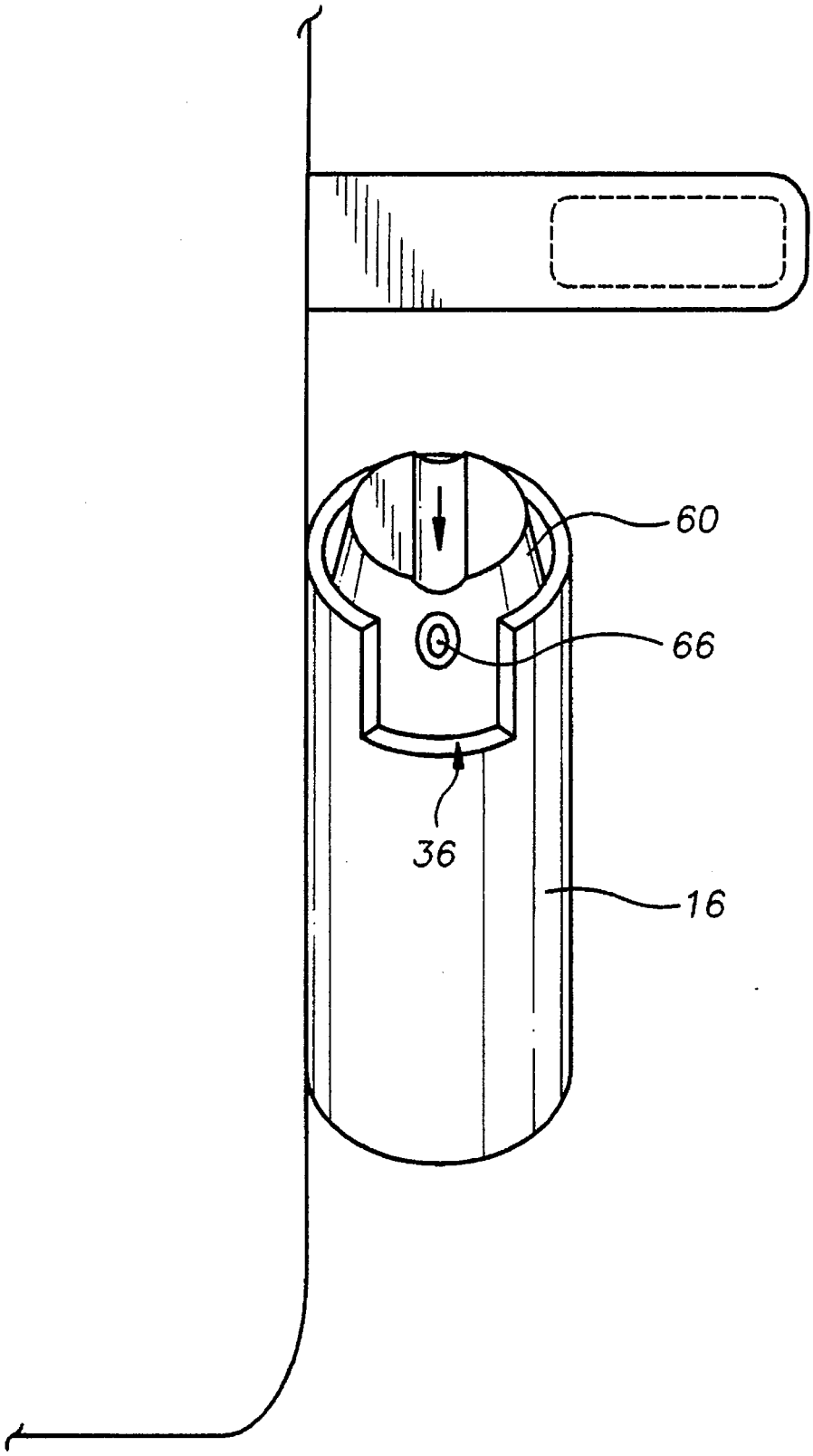
FIG. 5 is a perspective detail view of the canister receiving member of the embodiment shown in FIG. 1 with the representative liquid repellant canister of FIG. 4 installed therein.

FIG. 5 shows repellant canister 60 installed within receiving member 16. Repellant canister 60 is positioned within canister cavity 32 in a manner such that any stream of liquid repellant discharged from nozzle orifice 66 is directed through nozzle aperture 36.

Figure 6:
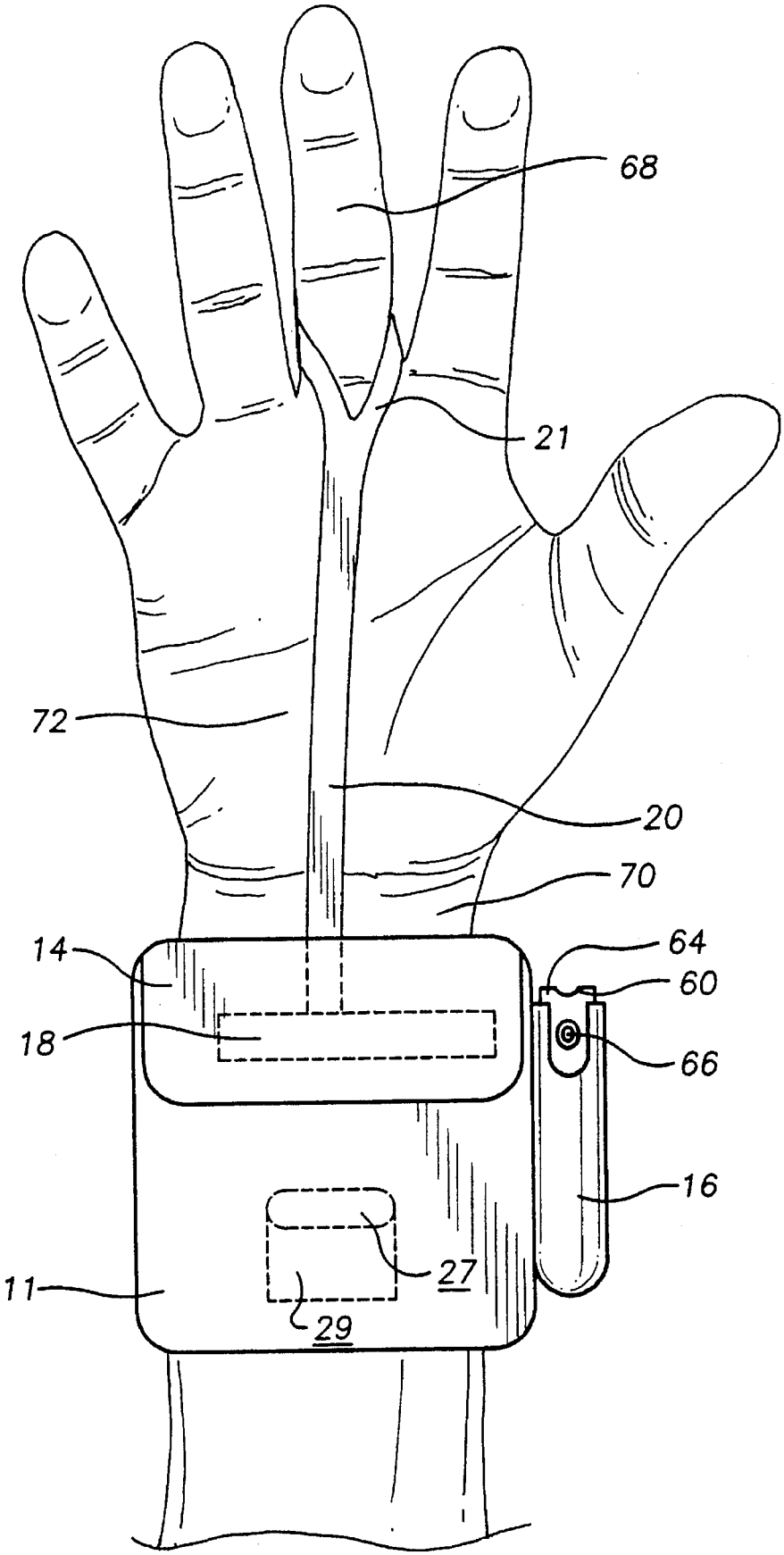
FIG. 6 is a side view showing the hand and forearm of a representative user with the safety device of FIG. 1 attached.

Use of the exemplary embodiment of safety device 10 with a repellant canister 60 installed within receiving member 16 is now described with reference to FIG. 6. Loop 21 of support strap 20 is placed over the middle finger 68 of the right hand with support strap 20 next to the palm section 72 of the right hand. Pouch member 11 is placed on the interior of the forearm 70 and securely attached with wrist strap 18.

Storage chamber 12 provides storage for small items and articles of identification. Aperture 27 in conjunction with second cavity 29 provide a means for attaching the clip of a beeper to storage pouch 11. When a person wearing safety device 10 is attacked, the person will reflexively raise his/her hand with the palm directed at the attacker. As shown in the figure, nozzle orifice 66 is pointed in a direction substantially perpendicular to the palm 72 of the user. The user need only depress nozzle 64 with a finger of his/her left hand to discharge a stream of liquid repellant in the direction of the attacker.

An exemplary embodiment of the repellant carrying method of the invention is now described with general reference to FIGS. 1–6. The carrying method includes the following steps: a) providing a safety device 10 as described herein above; b) providing a liquid repellant canister 60 containing a supply of liquid repellant and having a nozzle 64 including a nozzle orifice 66; c) placing loop 21 of support strap 20 over the middle finger of the hand to which safety device 10 is to be attached; d) attaching wrist strap 18 about the wrist of a user; and e) installing repellant canister 60 into canister receiving member 16 in a manner such that nozzle orifice 66 is oriented through nozzle aperture 36.

It can be seen from the preceding description that a method and device for self protection which has a receptacle for carrying liquid repellant, where the repellant can be discharged in the direction of an assailant when the arm is raised as in a defensive reflex without the canister of repellant having to be removed or aimed has been provided.

It is noted that the embodiment of the safety device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A safety device for holding a canister of the type containing a supply of liquid repellant and having a nozzle including an orifice through which the liquid repellant is discharged in a predetermined direction with respect to the nozzle orifice, said safety device comprising:

a canister receiving member having a cavity having a longitudinal axis and of a size sufficient to receive therein a bottom portion of said canister;

a strap mechanism, attachable about the wrist of a user, and in functional connection with said canister receiving member in a manner such that when said strap mechanism is attached about the wrist of a user said longitudinal axis of said cavity is oriented along an exterior portion of the forearm said user; and a single elongated support strap having a first end in functional connection at a single point with said canister receiving member and ending at a second end; said second end formed with a loop for attaching said second end to a hand of said user in a manner such that said support strap acts to prevent said canister receiving member from sliding toward the elbow of a user when said strap mechanism is attached about the wrist of a user.

2. A safety device comprising:

a canister containing a supply of liquid repellant and having a nozzle including an orifice through which the liquid repellant is discharged in a predetermined direction with respect to the nozzle orifice;

a pouch member having a storage chamber therein accessible through a securable flap;

a canister receiving member, mounted on a first exterior portion of said pouch member, having a cavity having a longitudinal axis and of a size sufficient to receive therein a bottom portion of said canister;

a strap mechanism, connected to a second exterior portion of said pouch member and attachable about the wrist of a user, in functional connection with aid canister receiving member in a manner such that when said strap mechanism is attached about the wrist of a user said longitudinal axis of said cavity is oriented along an exterior portion of the forearm of said user;

said cavity including an interior sidewall which frictionally contacts an exterior portion of said canister in a manner such that said bottom portion of said canister is retained within said cavity when said cavity is oriented any direction; said canister receiving member including a lip section, adjacent said cavity, having a notched section partially forming aperture through which said orifice of said nozzle may be directed; and a single elongated support strap having a first end in functional connection at a seingle point with said canister receiving member and ending at a second end; said second end formed with a loop for attaching said second end to a hand of said user in a manner such that said support strap acts to prevent said canister receiving member from sliding toward the elbow of a user when said strap mechanism is attached about the wrist of a user.

3. A method of carrying a supply of liquid repellant comprising the steps of:

a) providing a safety device comprising:

a canister receiving member having a cavity having a longitudinal axis and of a size sufficient to receive therein a bottom portion of said canister;

a strap mechanism, attachable about the wrist of a user, and in functional connection with said canister receiving member in a manner such that when said strap mechanism is attached about the wrist of a user said longitudinal axis of said cavity is oriented along an exterior portion of the forearm of said user, and a single elongated support strap having first end in functional connection at a single point with said canister receiving member and ending at a second end; said second end formed with a loop for attaching said second end to a hand of said user in a manner such that said support strap acts to prevent said canister receiving member from sliding toward the elbow of a user when said strap mechanism is attached about the wrist of a user;

b) providing a canister containing a supply of liquid repellant and having a nozzle including an orifice through which the liquid repellant is discharged in a predetermined direction with respect to the nozzle orifice;

c) attaching said strap mechanism about the wrist of a user;

d) installing said canister into said canister receiving member in a manner such that said predetermined direction with respect to said nozzle orifice is oriented within 35 degrees of a line perpendicular to the interior portion of the user's wrist; and e) attaching said second end of said support strap to said hand of said user by positioning a finger of said hand through said loop.

* * * * *